US010680358B2

(12) United States Patent
Morello et al.

(10) Patent No.: US 10,680,358 B2
(45) Date of Patent: Jun. 9, 2020

(54) METHOD FOR SECURING A TERMINAL WITHIN A CONNECTOR HOUSING OF A CONNECTOR ASSEMBLY AND A CONNECTOR ASSEMBLY FORMED BY SAID METHOD

(71) Applicant: Aptiv Technologies Limited, St. Michael OT (BB)

(72) Inventors: John R. Morello, Warren, OH (US); James M. Rainey, Warren, OH (US)

(73) Assignee: Aptiv Technologies Limited (BB)

( * ) Notice: Subject to any disclaimer, the term of this patent is extended or adjusted under 35 U.S.C. 154(b) by 38 days.

(21) Appl. No.: 16/059,589

(22) Filed: Aug. 9, 2018

(65) Prior Publication Data

US 2020/0052421 A1 Feb. 13, 2020

(51) Int. Cl.

| | |
|---|---|
| ***H01R 11/18*** | (2006.01) |
| ***H01R 9/24*** | (2006.01) |
| ***H01R 13/24*** | (2006.01) |
| ***H01R 13/627*** | (2006.01) |

(52) U.S. Cl.

CPC ..... *H01R 11/18* (2013.01); *H01R 9/2433* (2013.01); *H01R 13/2407* (2013.01); *H01R 13/2471* (2013.01); *H01R 13/6278* (2013.01)

(58) Field of Classification Search

CPC ..... H01R 13/422; H01R 13/405; H01R 13/2407; H01R 13/18

USPC ..... 439/733.1, 736, 877

See application file for complete search history.

(56) References Cited

U.S. PATENT DOCUMENTS

| | | | | |
|---|---|---|---|---|
| 3,993,396 | A * | 11/1976 | Eigenbrode | H01R 13/422 439/736 |
| 4,092,058 | A * | 5/1978 | Eigenbrode | H01R 13/405 439/709 |
| 5,409,404 | A * | 4/1995 | Reed | H01R 13/405 439/736 |
| 5,711,067 | A * | 1/1998 | Jenner | H01R 4/2429 29/874 |
| 5,836,792 | A * | 11/1998 | Thumma | H01R 12/585 439/736 |
| 5,997,340 | A * | 12/1999 | Ito | H01R 43/0207 439/460 |
| 6,442,832 | B1 * | 9/2002 | Noble | H01R 43/048 174/261 |
| 7,226,320 | B2 * | 6/2007 | Abe | H01R 24/58 439/595 |
| 7,285,011 | B2 | 10/2007 | Hardy et al. | |
| 7,371,979 | B2 * | 5/2008 | Fuzetti | H01R 9/2433 200/17 R |
| 7,794,274 | B2 | 9/2010 | Phillips, Jr. | |
| 8,109,799 | B2 * | 2/2012 | Schlipf | H01R 13/432 439/736 |
| 8,366,483 | B2 | 2/2013 | Hardy et al. | |
| 9,142,895 | B2 | 9/2015 | Hardy et al. | |

* cited by examiner

*Primary Examiner* — Tulsidas C Patel
*Assistant Examiner* — Marcus E Harcum
(74) *Attorney, Agent, or Firm* — Robert J. Myers

(57) ABSTRACT

A method of securing an electrical terminal within a terminal cavity of a connector body is described herein. The method includes the step of deforming a portion of an outer surface of the connector body to fabricate a protrusion that projects from an inner surface of the connector body into the terminal cavity, thereby securing the electrical terminal within the terminal cavity. A connector assembly formed by this method is also described.

18 Claims, 4 Drawing Sheets

METHOD FOR SECURING A TERMINAL WITHIN A CONNECTOR HOUSING OF A CONNECTOR ASSEMBLY AND A CONNECTOR ASSEMBLY FORMED BY SAID METHOD

TECHNICAL FIELD OF THE INVENTION

The invention generally relates to connector assemblies, particularly a method for securing a terminal within a connector housing of a connector assembly and a connector assembly formed by this method.

BACKGROUND OF THE INVENTION

Resilient locking tangs 2, as illustrated in FIGS. 1A and 1B, have been used to retain electrical terminals 4 within terminal cavities 6 of connector bodies 8. These locking tangs 2 have been found to have several drawbacks. The features of stamping dies that are used to form these locking tangs 2 have been found to require a great deal of die maintenance since these features tend to wear rather quickly. Further, the locking tangs 2 cause a variation in terminal location within the terminal cavity 6 because of the over travel required to assure locking of the locking tang 1 when the electrical terminal 4 is inserted into the terminal cavity 6. Additionally, there may be a wide variance in the insertion force required to seat the electrical terminal 4 within the terminal cavity 6. This has been found to be especially prevalent in smaller terminals, i.e. having a diameter of 0.5 mm or less. Therefore a method for securing a terminal within a connector housing reduces or eliminates these issues is desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a method of securing an electrical terminal within a connector body is provided. This method includes step a) providing the connector body defining a longitudinal terminal cavity therethrough and step b) providing the electrical terminal. The electrical terminal includes a first connection portion configured to attach the electrical terminal to a first conductor, e.g. a first corresponding terminal, a second connection portion configured to interconnect with a second conductor, e.g. a second corresponding terminal, and a transition portion intermediate the first connection portion and the second connection portion. The method further includes step c) disposing the electrical terminal within the terminal cavity and step d) deforming a portion of an outer surface of the connector body to fabricate a protrusion that projects from an inner surface of the connector body into the terminal cavity intermediate the first connection portion and the second connection portion, thereby securing the electrical terminal within the terminal cavity. The steps c) and d) are preferably performed in the order listed.

The protrusion may be characterized as having a generally domic shape. The protrusion may be formed by pressing the outer surface of the connector body toward the inner surface of the terminal cavity using a generally cylindrical probe. An end of the probe contacting the outer surface has a generally flat central section concentrically surrounded by a compound curved section having a convex-concave-convex profile. The inner surface of the terminal cavity may define a ridge which extends from the inner surface into the terminal cavity. This ridge is preferably formed prior to step c). The ridge is configured to engage the second connection portion of the electrical terminal.

A radial distance between the portion of the outer surface of the connector body and the inner surface of the terminal cavity may be less than a radial distance between a remaining portion of the outer surface and the inner surface.

The connector body is preferably formed of a polymeric material, e.g. 20% glass filled polybutylene terephthalate.

In accordance with another embodiment, a connector assembly is provided. This connector assembly is formed by the method described above.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1A:
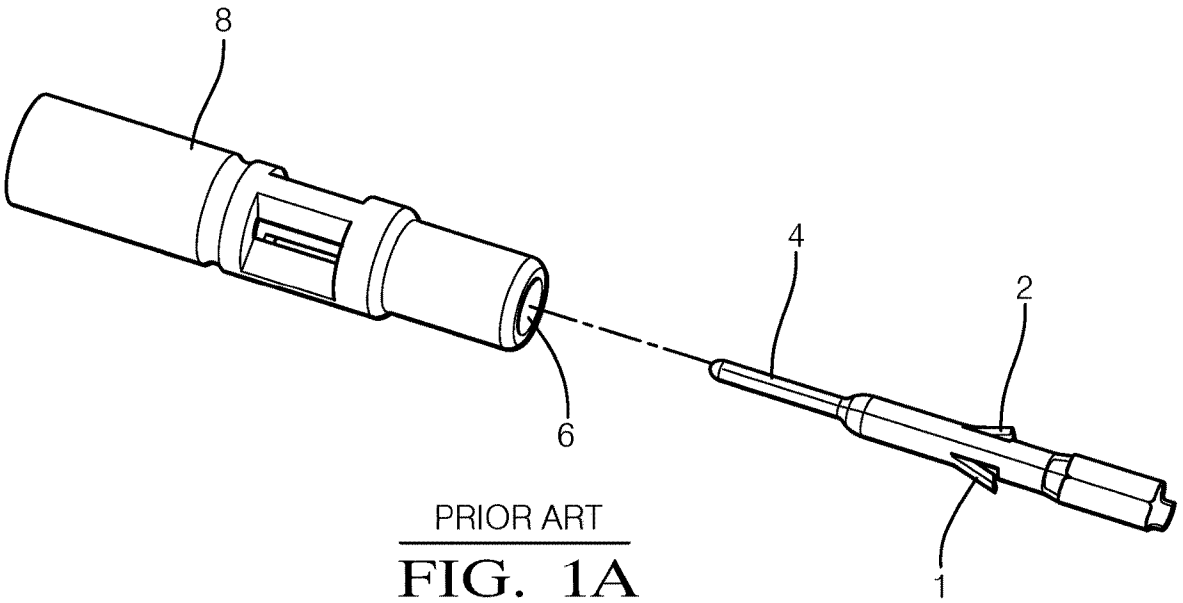
PRIOR ART FIG. 1A
FIG. 1A is an exploded perspective view of a connector assembly according to the prior art.

The problem of securing an electrical terminal within a terminal cavity of a connector body of a connector assembly are solved by deforming a portion of the connector body to fabricate a protrusion that projects from an inner surface of the connector body into the terminal cavity after the electrical terminal has been inserted into the terminal cavity.

In the following description, orientation terms such as "longitudinal" will refer to the mating axis X while "lateral" refers to an axis perpendicular to the mating axis, which is not necessarily the transverse axis. Furthermore, terms relating to "top" "bottom", "upper", and "lower" are to be understood relative to an axis perpendicular to the mating axis X, which is not necessarily the vertical axis. As used herein the terms "front" and "forward" refer to a lateral orientation from the first connector towards the second connector and the terms "back", "rear", "rearward", and "behind" refer to a lateral orientation oriented from the second connector towards the first connector.

Figure 3:
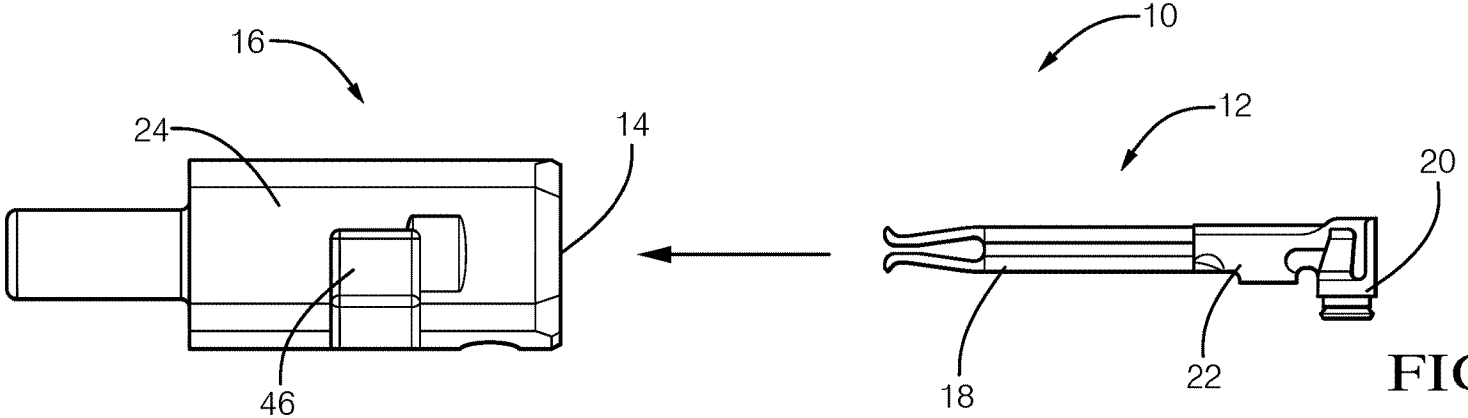
FIG. 3 is an exploded perspective view of a connector assembly according to an embodiment of the invention.
Figure 4C:
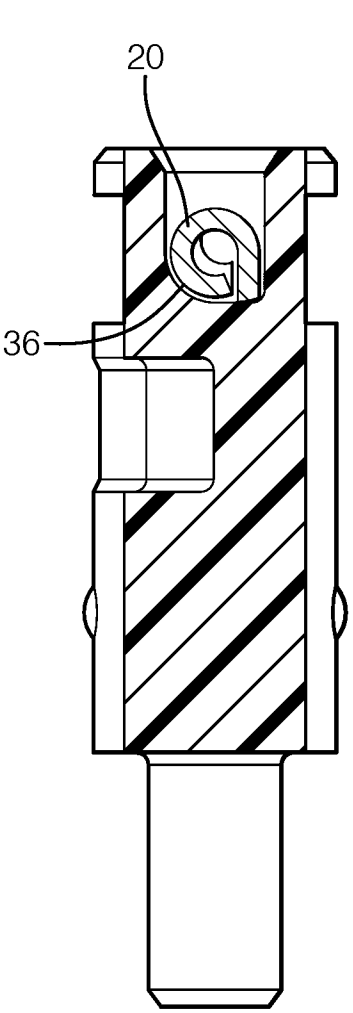
FIG. 4C is an alternative cross section side view of the connector assembly of FIG. 3 according to an embodiment of the invention.
Figure 4B:
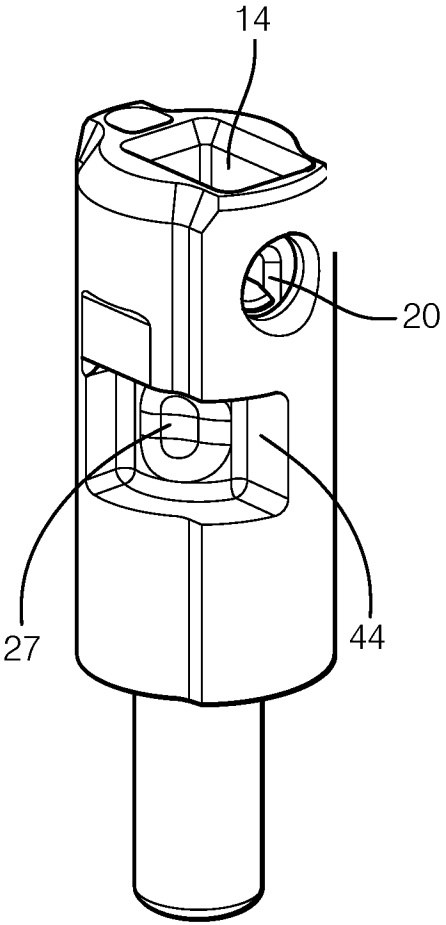
FIG. 4B is a perspective assembled view of the connector assembly of FIG. 3 according to an embodiment of the invention.
Figure 4A:
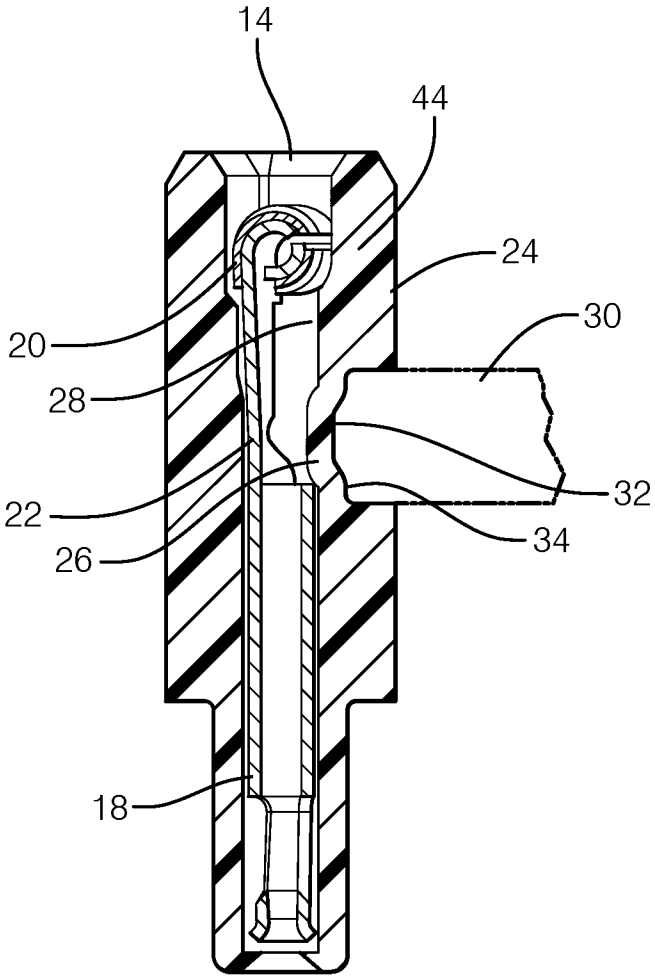
FIG. 4A is cross section side view of the connector assembly of FIG. 3 according to an embodiment of the invention.

FIGS. 2 through 5 illustrate a non-limiting example of a method 100 of forming a connector assembly 10 by securing an electrical terminal 12 within a terminal cavity 14 of a connector body 16. The method 100 includes the following steps:

Step 102, Provide a Connector Body Defining A LONGITUDINAL TERMINAL CAVITY, includes providing a connector body 16 defining a longitudinal terminal cavity 14 therethrough as best illustrated in FIGS. 3 and 4A. The connector body 16 is formed by injection molding an electrically insulative polymeric material within a mold. The material is preferably a 20% glass filled polybutylene terephthalate (PBT) material, although other suitable engineered plastic materials such as polyamide (PA, NYLON) or acrylonitrile butadiene styrene (ABS) may also be used.

STEP 104, PROVIDE AN ELECTRICAL TERMINAL, includes providing an electrical terminal 12 as illustrated in FIG. 3. The electrical terminal 12 includes a first connection portion 18 that is configured to attach the electrical terminal 12 to a first conductor (not shown). In the illustrated example, the first connection portion 18 is a female socket that is configured to receive a male pin terminal. The electrical terminal 12 also includes a second connection portion 20 configured to interconnect with a second conductor (not shown). According to the illustrated example, the second connection portion 20 is another female socket that is configured to receive another male pin terminal oriented at a right angle relative to the male terminal received by the first connection portion 18. The electrical terminal 12 further includes a transition portion 22 intermediate the first connection portion 18 and the second connection portion 20. As best shown in FIG. 4A, the transition portion 22 is flat and has a smaller lateral dimension than either the first connection portion 18 or the second connection portion 20. The electrical terminal 12 illustrated here is formed from a metal sheet that is stamped in a stamping die and bent to the desired shape.

Alternative embodiments may include an electrical terminal that is formed by other manufacturing processes, such as casting or machining. Other embodiments may include a first or second connection portion that is a male pin or blade terminal. Yet other embodiments may have a first or second connection portion that is configured to be connected to a wire cable via crimping, soldering, welding, or other known wire/terminal attachment features.

Step 106, Dispose the Electrical Terminal within the TERMINAL CAVITY, includes inserting the electrical terminal 12 within the terminal cavity 14 as best illustrated in FIGS. 3 and 4A.

Step 108, Deform a Portion of an Outer Surface of the CONNECTOR BODY TO FABRICATE A PROTRUSION THAT PROJECTS FROM AN INNER SURFACE OF THE CONNECTOR BODY INTO THE TERMINAL CAVITY, includes deforming a portion of an outer surface 24 of the connector body 16 to fabricate a protrusion 26 that projects from an inner surface 28 of the connector body 16 into the terminal cavity 14 intermediate the first connection portion 18 and the second connection portion 20, thereby securing the electrical terminal 12 within the terminal cavity 14. STEPS 106 and 108 are performed in the order listed here.

The protrusion 26 is formed by pressing the outer surface 24 of the connector body 16 toward the inner surface 28 of the terminal cavity 14 using a rigid, generally cylindrical probe 30. A tip of the probe 30 contacting the outer surface 24 has a generally flat central section 32 concentrically surrounded by a compound curved section 34 having a convex-concave-convex profile. The protrusion 26 is cold-formed at ambient temperature i.e. within a temperature range of 20° C. to 25° C. The force applied to the probe 30 to form the protrusion 26 is dependent upon the material used to form the probe 30 and the geometry of the probe tip. The formation of the protrusion 26 forms a corresponding indentation 27 in the outer surface 24 of the connector body 16.

The inner surface 28 defines a ridge or stop 36 that extends from the inner surface 28 of the connector body 16 into the terminal cavity 14. This stop 36 engages the second connection portion 20 of the electrical terminal 12, thereby preventing further insertion of the electrical terminal 12 into the terminal cavity 14. The stop 36 is preferably formed when the connector body 16 is molded, in any case before the deformation of the connector body 16 to form the protrusion 26 in STEP 108.

Figure 5:
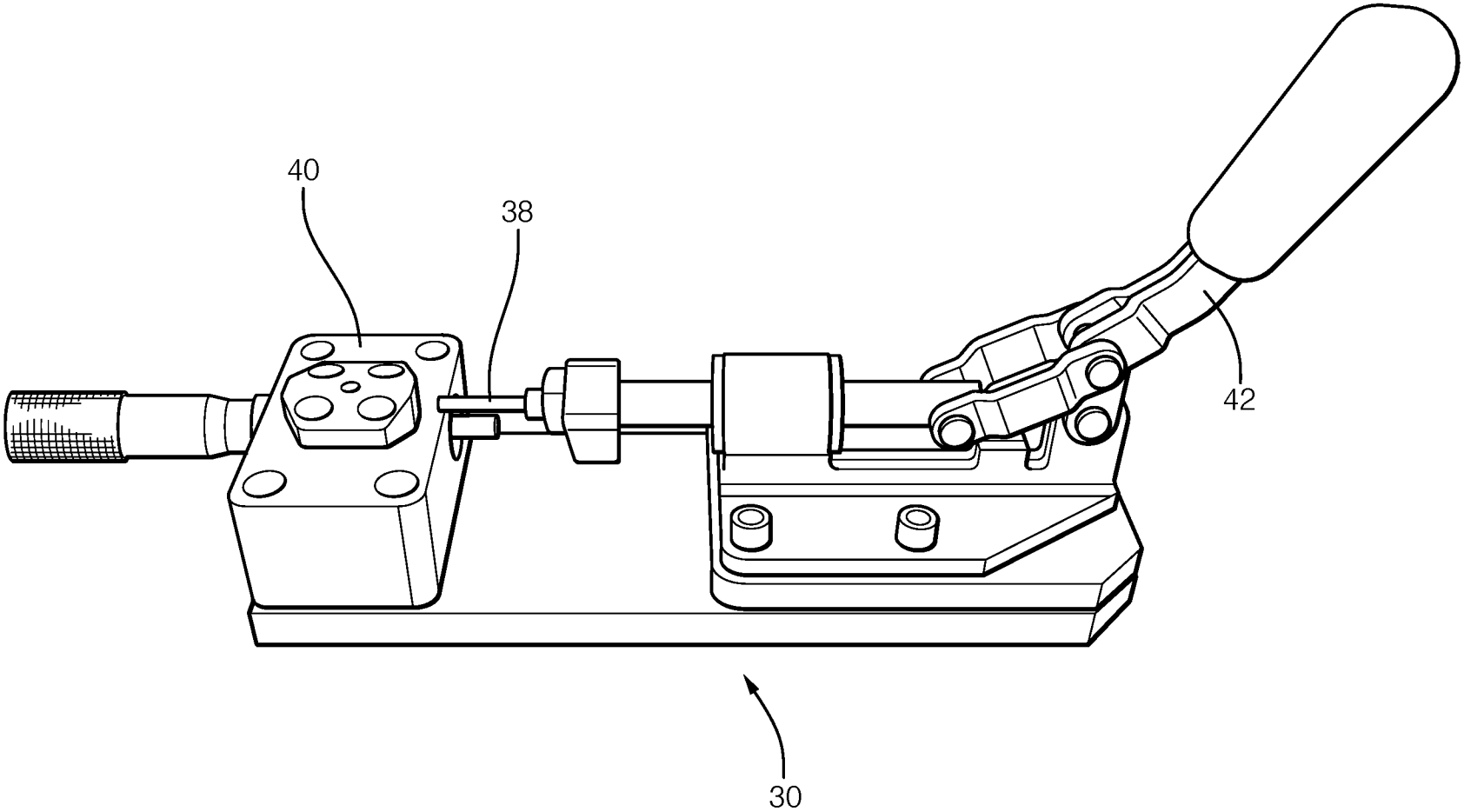
FIG. 5 is a perspective view of a fixture for assembling the connector assembly of FIG. 3 according to an embodiment of the invention.

FIG. 5 illustrates a non-limiting example of a fixture 38 that is configured to form the protrusion 26 in the connector body 16. The connector body 16 is held in a clamping device 40 and the probe 30 is attached to a lever 42 that is configured to apply sufficient force to the probe 30 to form the protrusion 26. Travel of the lever 42 is limited to ensure that the size of the protrusion 26 is sufficient to retain the electrical terminal 12 within the cavity without causing the protrusion 26 to contact the electrical terminal 12, thereby preventing possible damage of the electrical terminal 12.

As best shown in FIG. 3, the thickness of a section of the connector body wall 44 between the outer surface 24 and the inner surface 28 is reduced or thinned relative to the surrounding portion of the connector body wall 44 prior to forming the protrusion 26. This thinned section 46 of the connector body wall 44 is preferably formed when the connector body 16 is molded. The reduced thickness of the thinned section 44 reduces a lateral or a radial distance between the portion of the outer surface 24 of the connector body 16 and the inner surface 28 of the terminal cavity 14, thereby reducing the force needed to be applied to the probe 30 to form the protrusion 26. This thinned section 46 also reduces the likelihood of cracking the connector body 16 when forming the protrusion 26.

While the illustrated example of the connector assembly 10 shows one terminal cavity 14 and an associated electrical terminal 12, other embodiments may be envisioned in which a connector body defines multiple cavities and contains multiple electrical terminals. In addition, although the examples presented herein are directed to electrical connector assemblies, other embodiments of the connector assembly may be envisioned that are adapted for use with optical cables or hybrid connections including both electrical and optical cables. Yet other embodiments of the connector assembly may be envisioned that are configured for connecting pneumatic or hydraulic lines.

Figure 1B:
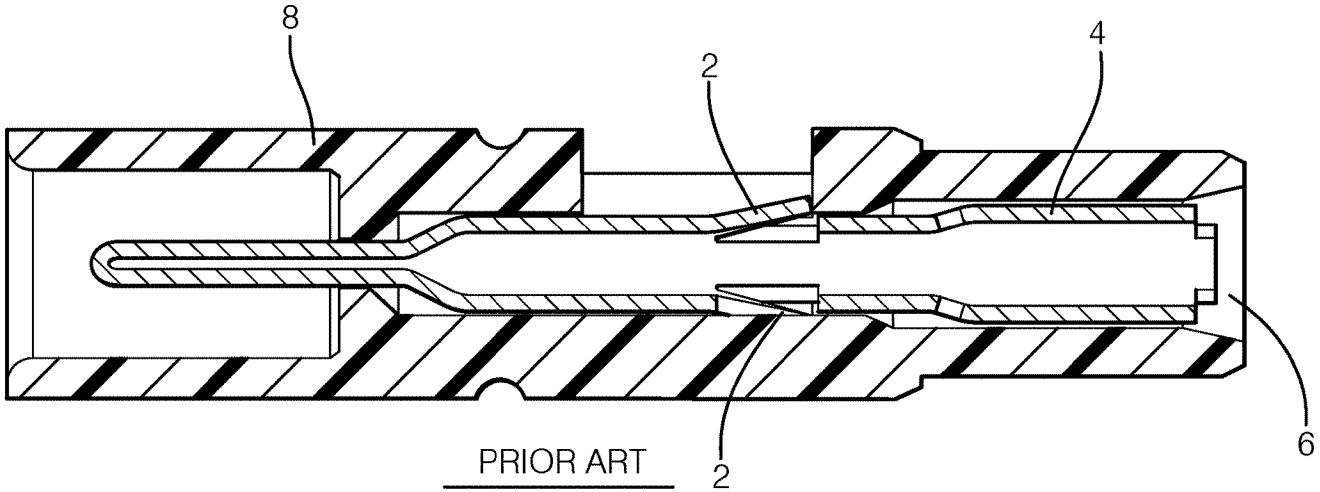
PRIOR ART FIG. 1B
FIG. 1B is cross section side view of the connector assembly of FIG. 1A according to the prior art.
Figure 2:
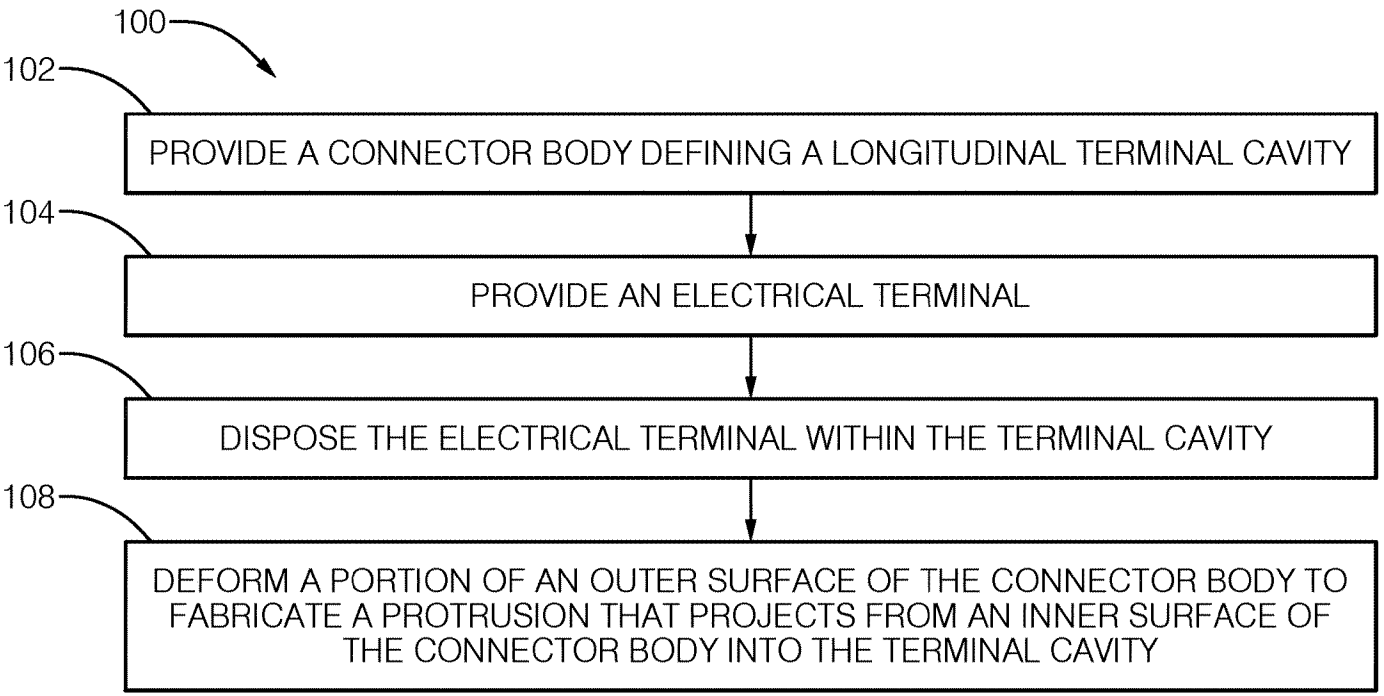
FIG. 2 is a flow chart of a method of securing an electrical terminal within a connector body according to an embodiment of the invention.

Accordingly a method 100 securing an electrical terminal 12 within a terminal cavity 14 of a connector body 16 of a connector assembly 10 and the connector assembly 10 formed by such a method 100 is provided. This method 100 provides the advantages of reducing the insertion force required to insert the electrical terminal 12 within the terminal cavity 14 by eliminating locking features on the electrical terminal, such as the locking tangs 2 shown in FIGS. 1A and 1B, or flexible locking features formed in the connector body. The elimination of the locking tangs 2 also eliminates the sensitive, high maintenance features in the stamping dies that form the electrical terminal 12. The method 100 further decreases variation in the longitudinal locational of the electrical terminal 12 within the terminal cavity 14 because over travel needed to seat flexible locking features is not required. This is particularly beneficial for radio frequency (RF) connector assemblies. The method 100 also provides improved terminal retention performance over prior art connector assembles.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC § 112(f), unless and until such claim limitations expressly use the phrase "means for" followed by a statement of function void of further structure.

We claim:

1. A method of securing an electrical terminal within a connector body, said method comprising the steps of:

a) providing the connector body defining a longitudinal terminal cavity therethrough;

b) providing the electrical terminal, wherein the electrical terminal includes a first connection portion configured to attach the electrical terminal to a first conductor, a second connection portion configured to interconnect with a second conductor, and a transition portion intermediate the first connection portion and the second connection portion;

c) disposing the electrical terminal within the terminal cavity; and d) deforming a portion of an outer surface of the connector body to fabricate a protrusion that projects from an inner surface of the connector body into the terminal cavity intermediate the first connection portion and the second connection portion, thereby securing the electrical terminal within the terminal cavity wherein the protrusion is formed by pressing the outer surface of the connector body toward the inner surface of the terminal cavity using a probe with an end contacting the outer surface having a generally flat central section concentrically surrounded by a compound curved section having a convex-concave-convex profile.

2. The method according to claim 1, wherein the protrusion is characterized as having a generally domic shape.

3. The method according to claim 1, wherein steps c) and d) are performed in the order listed.

4. The method according to claim 1, wherein the probe is generally cylindrical.

5. The method according to claim 1, wherein the inner surface defines a ridge extending from the inner surface into the terminal cavity, wherein the ridge is formed prior to step c), and wherein the ridge is configured to engage the second connection portion of the electrical terminal.

6. The method according to claim 1, wherein a radial distance between the portion of the outer surface of the connector body and the inner surface of the terminal cavity is less than a radial distance between a remaining portion of the outer surface and the inner surface.

7. The method according to claim 1, wherein the connector body is formed of a polymeric material.

8. The method according to claim 7, wherein the polymeric material is 20% glass filled polybutylene terephthalate.

9. The method according to claim 1, wherein the first conductor is a first corresponding electrical terminal and the second conductor is a second corresponding electrical terminal.

10. A connector assembly formed by a process comprising the steps of:

a) providing the connector body defining a longitudinal terminal cavity therethrough;

b) providing the electrical terminal, wherein the electrical terminal includes a first connection portion configured to attach the electrical terminal to a first conductor, a second connection portion configured to interconnect with a second conductor, and a transition portion intermediate the first connection portion and the second connection portion;

c) disposing the electrical terminal within the terminal cavity; and d) deforming a portion of an outer surface of the connector body to fabricate a protrusion that projects from an inner surface of the connector body into the terminal cavity intermediate the first connection portion and the second connection portion, thereby securing the electrical terminal within the terminal cavity wherein the protrusion is formed by pressing the outer surface of the connector body toward the inner surface of the terminal cavity using a probe with an end contacting the outer surface having a generally flat central section concentrically surrounded by a compound curved section having a convex-concave-convex profile.

11. The connector assembly according to claim 10, wherein the protrusion is characterized as having a generally domic shape.

12. The connector assembly according to claim 10, wherein steps c) and d) are performed in the order listed.

13. The connector assembly according to claim 10, wherein the probe is generally cylindrical.

14. The connector assembly according to claim 10, wherein the inner surface defines a ridge extending from the inner surface into the terminal cavity, wherein the ridge is formed prior to step c), and wherein the ridge is configured to engage the second connection portion of the electrical terminal.

15. The connector assembly according to claim 10, wherein a radial distance between the portion of the outer surface of the connector body and the inner surface of the terminal cavity is less than a radial distance between a remaining portion of the outer surface and the inner surface.

16. The connector assembly according to claim 10, wherein the connector body is formed of a polymeric material.

17. The connector assembly according to claim 10, wherein the polymeric material is 20% glass filled polybutylene terephthalate.

18. The connector assembly according to claim 10, wherein the first conductor is a first corresponding electrical terminal and the second conductor is a second corresponding electrical terminal.

* * * * *